US010360740B2

(12) United States Patent
Kapoor et al.

(10) Patent No.: US 10,360,740 B2
(45) Date of Patent: Jul. 23, 2019

(54) METHODS AND SYSTEMS FOR DIAGNOSING A VEHICLE USING SOUND

(71) Applicant: Robert Bosch GmbH, Stuttgart (DE)

(72) Inventors: Rahul Kapoor, Palo Alto, CA (US); Sascha Vetter, Palo Alto, CA (US); Goktug Tankut Cinar, Palo Alto, CA (US); Carlos Eduardo Cunha, Palo Alto, CA (US); Jeffrey Keating Thompson, Palo Alto, CA (US)

(73) Assignee: Robert Bosch GmbH, Stuttgart (DE)

( * ) Notice: Subject to any disclaimer, the term of this patent is extended or adjusted under 35 U.S.C. 154(b) by 201 days.

(21) Appl. No.: 15/407,915

(22) Filed: Jan. 17, 2017

(65) Prior Publication Data

US 2017/0206718 A1 Jul. 20, 2017

Related U.S. Application Data

(60) Provisional application No. 62/280,664, filed on Jan. 19, 2019.

(51) Int. Cl.
*G07C 5/00* (2006.01)
*G07C 5/08* (2006.01)

(52) U.S. Cl.
CPC ..... *G07C 5/0808* (2013.01); *G07C 5/006* (2013.01); *G07C 5/008* (2013.01); *G07C 2205/02* (2013.01)

(58) Field of Classification Search
CPC .. G07C 5/0808; G07C 5/0816; G07C 5/0833; G07C 5/006; G07C 5/008; G07C 2205/02
USPC ..... 701/31.4
See application file for complete search history.

(56) References Cited

U.S. PATENT DOCUMENTS

2003/0187557 A1 10/2003 Shockley
2005/0149234 A1* 7/2005 Vian ..... G05B 23/024 700/279
2006/0253282 A1* 11/2006 Schmidt ..... G07C 5/0808 704/233

(Continued)

FOREIGN PATENT DOCUMENTS

EP 1703471 A1 9/2006
GB 2388666 A 11/2003

OTHER PUBLICATIONS

International Search Report for Application No. PCT/EP2017/050926 dated Apr. 4, 2017 (5 pages).

*Primary Examiner* — Krishnan Ramesh
(74) *Attorney, Agent, or Firm* — Michael Best & Friedrich LLP

(57) ABSTRACT

Systems and methods for diagnosing a vehicle using sound data. One system includes a server storing a plurality of models and a communication device including a microphone. The communication device is configured to receive sound data received through the microphone associated with the vehicle and wirelessly transmit a diagnosis request to the server. The server is configured to receive the diagnosis request and select a model based on the vehicle data. The server is also configured to apply the selected model to the sound data to generate a response to the diagnosis request and wirelessly transmit the response to the diagnosis request to the communication device. The communication device is further configured to output at least a portion of the response on an output mechanism of the wireless communication device, the response including at least one diagnosis of the vehicle.

20 Claims, 8 Drawing Sheets

(56) References Cited

U.S. PATENT DOCUMENTS

| | | | | |
|---|---|---|---|---|
| 2009/0177354 | A1 | 7/2009 | Agrawal et al. | |
| 2009/0248236 | A1 | 10/2009 | Schwinke | |
| 2010/0082274 | A1 | 4/2010 | Son et al. | |
| 2011/0125366 | A1 | 5/2011 | Bertosa et al. | |
| 2011/0238258 | A1 | 9/2011 | Singh et al. | |
| 2012/0316835 | A1* | 12/2012 | Maeda | G01D 3/08 702/183 |
| 2013/0073260 | A1* | 3/2013 | Maeda | G05B 23/0224 702/183 |
| 2013/0211663 | A1 | 8/2013 | Kirsch et al. | |
| 2013/0261879 | A1 | 10/2013 | Chen et al. | |
| 2014/0074435 | A1* | 3/2014 | Cohn | H04R 29/00 702/184 |
| 2015/0054657 | A1* | 2/2015 | Sanchez | G08B 21/18 340/902 |
| 2015/0206357 | A1 | 7/2015 | Chen et al. | |
| 2015/0269788 | A1* | 9/2015 | Elliott | G07C 5/008 701/31.5 |
| 2015/0269792 | A1 | 9/2015 | Wood | |
| 2016/0034998 | A1* | 2/2016 | Mansfield | G06Q 30/0627 705/26.63 |
| 2016/0048811 | A1* | 2/2016 | Asai | G06Q 10/20 705/305 |
| 2016/0071336 | A1* | 3/2016 | Owen | G07C 5/008 701/31.4 |
| 2016/0343180 | A1* | 11/2016 | Talwar | G07C 5/0808 |
| 2016/0364699 | A1* | 12/2016 | Steketee | G06Q 10/20 |
| 2017/0076514 | A1* | 3/2017 | Valeri | G05B 23/00 |
| 2017/0109947 | A1* | 4/2017 | Prokhorov | G07C 5/0816 |
| 2018/0137697 | A1* | 5/2018 | Dudar | G07C 5/0833 |
| 2018/0350167 | A1* | 12/2018 | Ekkizogloy | G07C 5/0808 |

* cited by examiner

METHODS AND SYSTEMS FOR DIAGNOSING A VEHICLE USING SOUND

RELATED APPLICATIONS

This application claims priority to U.S. Provisional Application No. 62/280,664, filed Jan. 19, 2016, the entire content of which is herein incorporated by reference.

FIELD

Embodiments of the invention relate to methods and systems for diagnosing a vehicle, such as identifying a vehicle component or system that is malfunctioning.

BACKGROUND

When a vehicle makes an unusual sound, the vehicle owner often consults a professional for inspection (e.g., a repair shop or a dealership service center). Such consultations may be expensive, inconvenient, and timely. Also, in some situations, by the time the vehicle owner takes the vehicle to a repair shop or service center, the sound may have changed or temporarily stopped, which may further complicate the diagnosis of the vehicle, cause a false diagnosis, or cause a vehicle malfunction to be overlooked.

SUMMARY

Accordingly, embodiments of the invention relate to methods and systems for performing vehicle diagnostics using vehicle sounds. For example, one embodiment of the invention provides a system for diagnosing a vehicle. The system includes a diagnostic tool and a server. The diagnostic tool includes a microphone for recording first sound data associated with a first vehicle. The server has a memory for storing instructions and an electronic processor for executing the instructions stored in the memory to receive training data, the training data including the first sound data and diagnostic data for the first vehicle, and develop a model based on the training data. The electronic processor also executes the instructions stored in the memory to receive a diagnosis request including second sound data associated with a second vehicle and determine a diagnosis for the second vehicle based on the second sound data and the model.

Another embodiment of the invention provides a system for diagnosing a vehicle. The system includes a server storing a plurality of models and a communication device including a microphone. The communication device is configured to receive sound data received through the microphone associated with the vehicle and wirelessly transmit a diagnosis request to the server over a communication network, the diagnosis request including the sound data and vehicle data. The server is configured to receive the diagnosis request and select a model from the plurality of models based on the vehicle data. The server is also configured to apply the model to the sound data to generate a response to the diagnosis request and wirelessly transmit the response to the diagnosis request to the communication device over the communication network. The communication device is further configured to output at least a portion of the response on an output mechanism of the communication device, the response including at least one diagnosis of the vehicle.

Yet another embodiment the invention provides a method of diagnosing a vehicle. The method includes providing a vehicle diagnostic application for installation on a communication device including an electronic processor and receiving, via the vehicle diagnostic application executed by the electronic processor of the communication device, vehicle data. The method also includes receiving, via the vehicle diagnostic application executed by the electronic processor of the communication device, sound data associated with the vehicle received through a microphone of the communication device. The method also includes transmitting, via the vehicle diagnostic application executed by the electronic processor of the communication device, a diagnosis request to a server over a wireless communication network. The diagnosis request includes the sound data and the vehicle data. The method also includes receiving, via the vehicle diagnostic application executed by the electronic processor of the communication device, a response to the diagnosis request from the server over the wireless communication network. The method also includes outputting, via the vehicle diagnostic application executed by the electronic processor of the communication device, at least a portion of the response on an output mechanism of the communication device. The response can include a diagnosis of the vehicle.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention.

Figure 1:
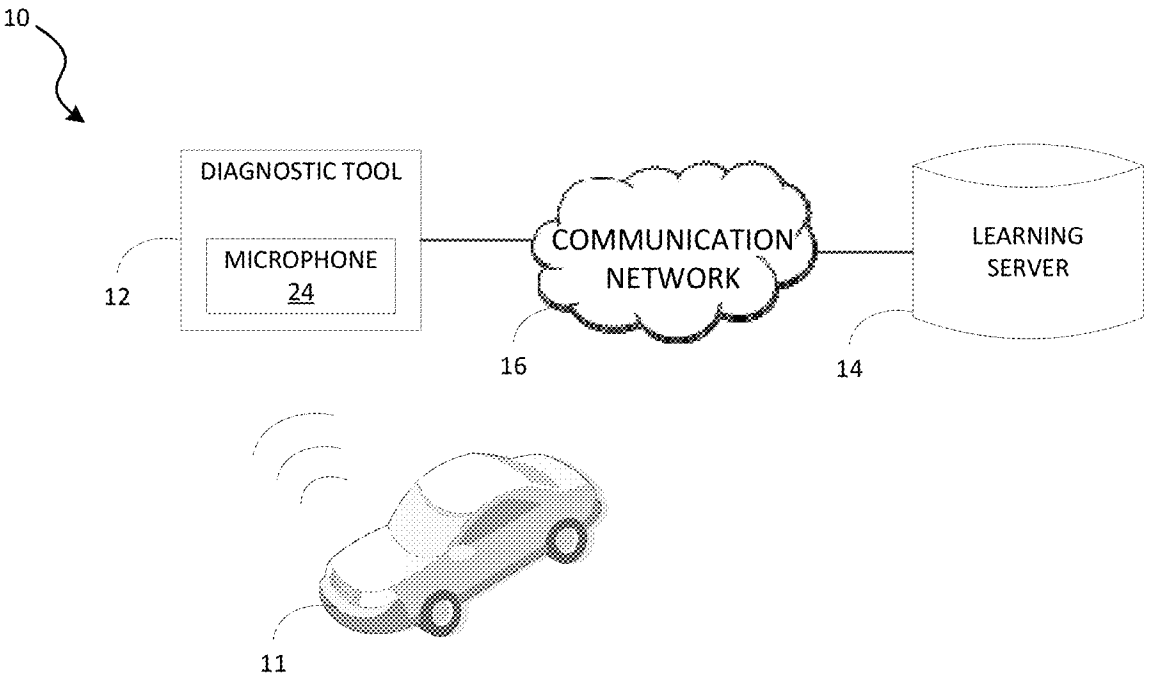
FIG. 1 is a schematic diagram illustrating a system for diagnosing a vehicle that includes a diagnostic tool and a learning server.

FIG. 1 illustrates a system 10 for diagnosing a vehicle according to one embodiment. The system 10 includes a diagnostic tool 12 and a learning server 14. In some embodiments, the diagnostic tool 12 communicates with (e.g., transmits data to) the learning server 14 over a communication network 16. The communication network 16 may include the Internet, a cellular network, a public network, a private network, or other wired or wireless network. It should be understood that in some embodiments, the communication network 16 includes a direct channel of communication between the diagnostic tool 12 and the learning server 14 (e.g., a dedicated wired connection). Furthermore, in some embodiments, the diagnostic tool 12 communicates with the learning server 14 indirectly through one or more intermediary computing devices. For example, the diagnostic tool 12 may communicate (e.g., through a wired or wireless connection or network) with an intermediary computing device (e.g., a desktop computer, a laptop computer, a tablet computer, a communication device, such as a smart telephone or smart wearable, and the like), and the intermediary computing device may communicate with the learning server 14 (e.g., through the communication network 16). For example, in some embodiments, the diagnostic tool 12 includes a connector or port for receiving a wired connection (e.g., a universal serial bus (USB) cable) that allows the diagnostic tool 12 to communicate with the intermediary computing device. Also, in some embodiments, the diagnostic tool 12 and the learning server 14 are combined into a single device.

The diagnostic tool 12 may include, for example, a hand-held device that communicates with a first vehicle 11. For example, the diagnostic tool 12 may be used by personnel at a repair shop or service center to diagnosis the first vehicle 11. The diagnostic tool 12 may diagnosis the first vehicle 11 by receiving data from the first vehicle 11, a user of the diagnostic tool 12, or a combination thereof.

Figure 2:
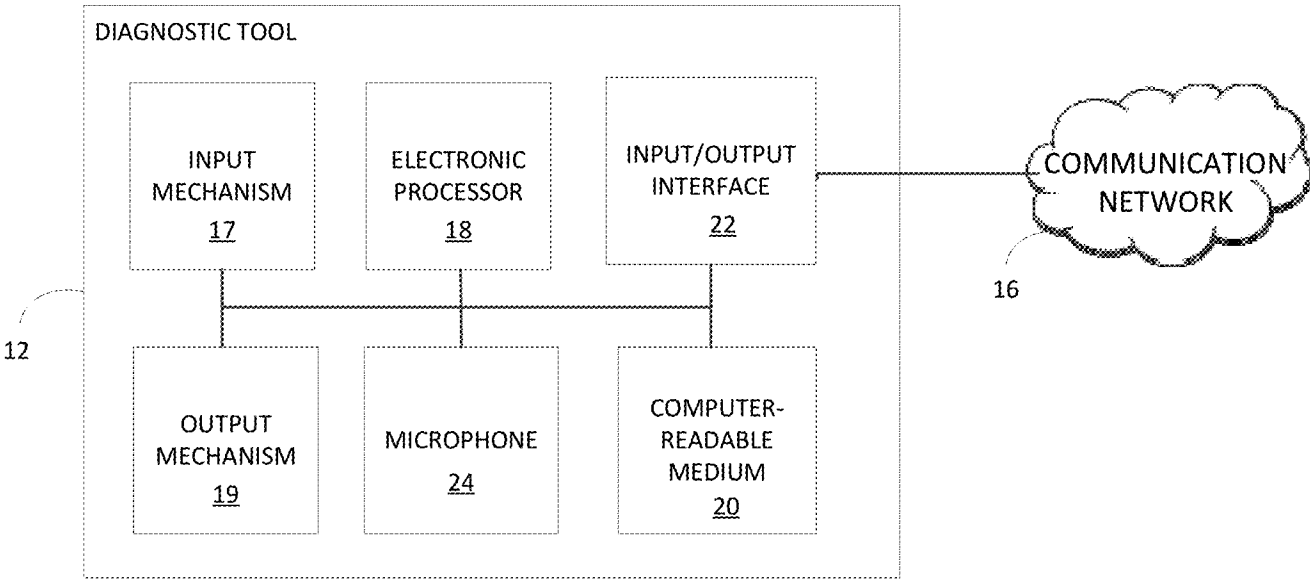
FIG. 2 is a block diagram illustrating the diagnostic tool of FIG. 1.

FIG. 2 schematically illustrates the diagnostic tool 12 according to one embodiment. As illustrated in FIG. 2, the diagnostic tool 12 includes an electronic processor 18 (e.g., a microprocessor or other programmable device), one or more input mechanisms 17, one or more output mechanisms 19, an input/output interface 22, a non-transitory computer-readable medium 20, and a microphone 24 communicating over one or more wired or wireless connections or buses. It should be understood that the diagnostic tool 12 may include fewer or additional components than as illustrated in FIG. 2 and may include components in configurations other than the configuration illustrated in FIG. 2. Also, the diagnostic tool 12 may be configured to perform additional functionality than the functionality described herein.

The electronic processor 18 is configured to retrieve instructions and data from the computer-readable medium 20 (e.g., read-only memory, random-access memory, or combinations thereof) and execute, among other things, the instructions. The input mechanisms 17 may include a keypad, a button, a keyboard, a mouse, a touchscreen, a trackball, a joystick, a camera, and the like for receiving input from a user of the diagnostic tool 12. Similarly, the output mechanisms 19 may include a display device, a speaker, a printer, and the like for providing output to a user of the diagnostic tool 12.

The input/output interface 22 transmits data from the diagnostic tool 12 to external systems, networks, and/or devices and receives data from external systems, networks, and/or devices. The input/output interface 22 may also store data received from external sources to the computer-readable medium 20 and/or provide received data to the electronic processor 18. As illustrated in FIG. 2, in some embodiments, the input/output interface 22 communicates with the communication network 16 (e.g., for communicating with the learning server 14). Alternatively or in addition, the input/output interface 22 may include a connector or port for receiving a wired connection to the learning server 14 or an intermediate computing device as described above (e.g., a USB cable).

Furthermore, in some embodiments, the input/output interface 22 communicates with a communication port or bus of a vehicle, such as a controller area network (CAN) bus, an on-board diagnostic (OBD) bus, and the like. For example, the input/output interface 22 may include a port or connector for receiving a cable that allows the diagnostic tool 12 to read data, such as one or more error codes, from a communication bus of the vehicle.

In some embodiments, the diagnostic tool 12 includes a power or start button (not shown) associated with the microphone 24. The power button allows a user of the diagnostic tool 12 to turn the microphone 24 on or off. For example, when the user turns the microphone 24 on (via the power button), sound data produced by the first vehicle 11 is received by the microphone 24 and stored to the computer-readable medium 20. In some embodiments, the computer-readable medium 20 may store multiple sound data files or recordings. The sound data may be stored as an audio file (e.g., a .WAV file or an .MP3 file). Also, in some embodiments, sound data stored to the computer-readable medium 20 may be linked with diagnostic data. The diagnostic data may include error codes read by the diagnostic tool 12 for the first vehicle 11. The diagnostic data may also include a diagnosis for the first vehicle 11, which may be manually entered by a user of the diagnostic tool 12 or automatically determined based on the error codes or other information received by the diagnostic tool 12 for the first vehicle 11. The diagnosis may identify one or more malfunctioning parts or systems of the first vehicle 11. The diagnosis may also identify suggested repair parts or service. The sound data may also be linked with vehicle data for the first vehicle 11 (e.g., a vehicle identification number (VIN), a vehicle make, a vehicle model, a vehicle year, a vehicle repair history, vehicle mileage, and the like). The vehicle data may also include a description of one or more problems reported by a user of the first vehicle 11. The vehicle data may be determined by the diagnostic tool 12 (e.g., by reading a VIN in the first vehicle 11 with a barcode reader or other device), input by a user of the diagnostic tool 12 (e.g., through one of the input mechanisms 17), or a combination thereof. Similarly, in some embodiments, the diagnostic tool 12 may determine the vehicle data by accessing one or more data sources, such as a database or other memory device storing repair history for one or more vehicles or a database or other memory device storing vehicle identification numbers and associated vehicle makes, models, and years.

It should be understood that the diagnostic data, the vehicle data, or both may be stored on the diagnostic tool 12 (e.g., within the computer-readable medium 20) or on a device external to the diagnostic tool 12. For example, in some embodiments, the diagnostic data is generated and stored on an intermediary computing device communicating with the diagnostic tool 12 as described above.

Figure 3:
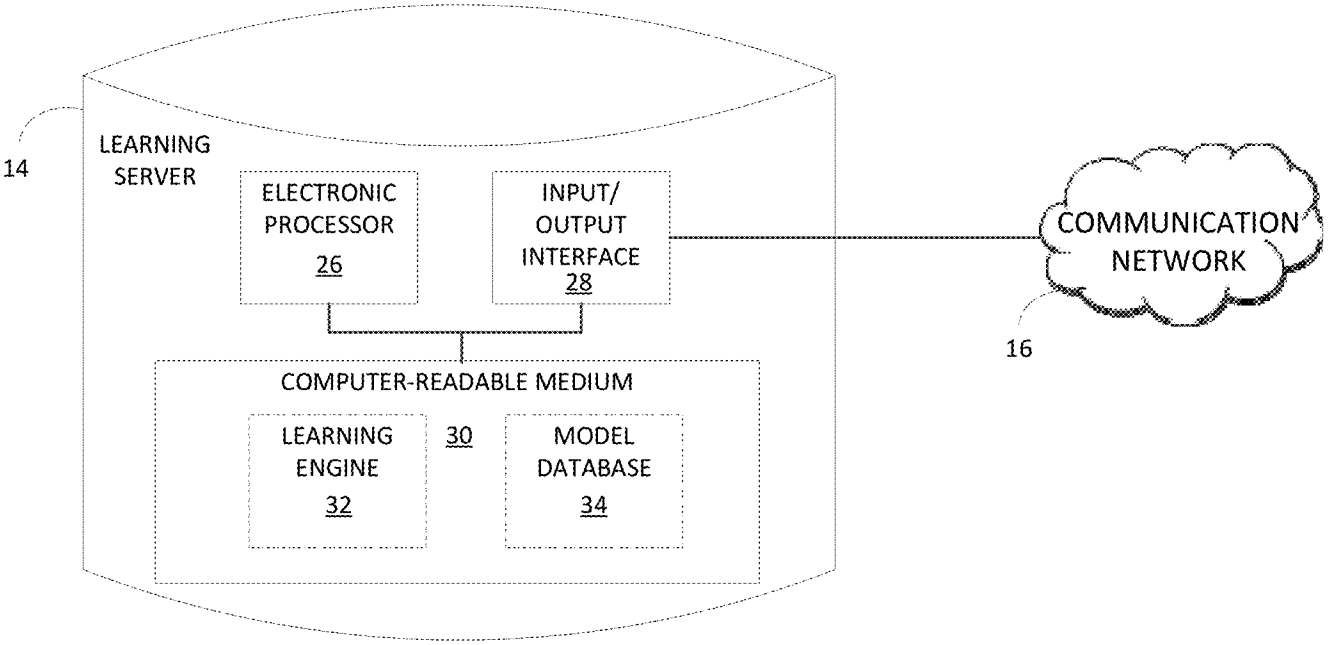
FIG. 3 is a block diagram illustrating the learning server of FIG. 1.

FIG. 3 schematically illustrates the learning server 14 according to one embodiment. As illustrated in FIG. 3, the learning server 14 includes an electronic processor 26 (e.g., a microprocessor or other programmable device), an input/output interface 28, and a non-transitory computer-readable medium 30. It should be understood that the learning server 14 may include fewer or additional components than as illustrated in FIG. 3 and may include components in configurations different than the configuration illustrated in FIG. 3. Also, the learning server 14 may be configured to perform additional functionality than the functionality described below. In addition, the functionality performed by the learning server 14 as described below may be distributed among multiple servers or devices.

The electronic processor 26 is configured to retrieve instructions and data from the computer-readable medium 30 (e.g., read-only memory, random-access memory, or combinations thereof) and execute, among other things, the instructions. In particular, as illustrated in FIG. 3, the computer-readable medium 30 may store a learning engine 32 and a model database 34. The electronic processor 26 is configured to execute instructions to perform a set of functions including the methods described herein.

The input/output interface 28 transmits data from the learning server 14 to external systems, networks, and/or devices and receives data from external systems, networks, and/or devices. The input/output interface 28 may also store data received from external sources to the computer-readable medium 30 and/or provide received data to the electronic processor 26. As illustrated in FIG. 3, in some embodiments, the input/output interface 28 communicates with the communication network 16 (e.g., for communicating with the diagnostic tool 12, an intermediary computing device, or both).

Figure 4:
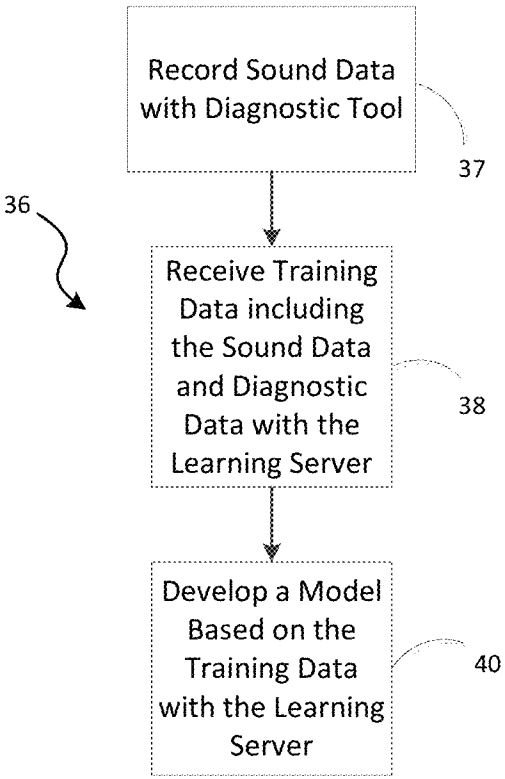
FIG. 4 is a flowchart illustrating a method of developing a model for diagnosing a vehicle using the system of FIG. 1.

FIG. 4 illustrates a method 36 of generating a model for diagnosing a vehicle performed by the system 10 according to one embodiment. As illustrated in FIG. 4, the method 36 recording sound data with the diagnostic tool 12 (i.e., the microphone 24) associated with the first vehicle 11 (at block 37). The method 36 also includes receiving, with the learning server 14, training data including the sound data and diagnostic data (at block 38).

In some embodiments, the learning server 14 receives the training data or a portion thereof from the diagnostic tool 12. For example, as noted above, in some embodiments, the diagnostic tool 12 communicates with the learning server 14. Therefore, when personnel at a repair shop or service center services the first vehicle 11, the personnel may record the sound data and communicate the sound data to the learning server 14. Alternatively, the diagnostic tool 12 may communicate the sound data to an intermediary computing device that, as described above, communicates with the learning server.

Similarly, the learning server 14 may receive the diagnostic data from the diagnostic tool. For example, during a consultation, personnel at a repair shop or service center may connect the diagnostic tool 12 to a communication bus of the first vehicle 11 and read the error codes. The diagnostic tool 12 may then communicate the error codes (and, optionally additional diagnostic data) to the learning server 14. Alternatively or in addition, the learning server 14 may receive the diagnostic data from another source, such as an intermediary computing device.

In some embodiments, the training data also includes vehicle data. Again, the learning server 14 may receive the vehicle data from the diagnostic tool 12 or a separate device, such as an intermediary computing device.

As illustrated in FIG. 4, the method 36 also includes developing at least one model, with the learning engine 32 of the learning server 14, based on the training data (at block 40). It should be understood that the learning server 14 may receive training data from multiple diagnostic tools 12 and may also receive training data from one or more devices separate from a diagnostic tool 12 (e.g., one or more intermediary computing devices), all of which may be used to develop one or more models.

In some embodiments, the learning engine 32 develops a model using one or more machine learning functions. Machine learning functions are generally functions that allow a computer application to learn without being explicitly programmed. In particular, a computer application performing machine learning functions (sometimes referred to as a learning engine) is configured to develop an algorithm based on training data. For example, to perform supervised learning, the training data includes example inputs and corresponding desired (e.g., actual) outputs, and the learning engine 32 progressively develops a model that maps inputs to the outputs included in the training data. Machine learning may be performed using various types of methods and mechanisms including but not limited to decision tree learning, association rule learning, artificial neural networks, inductive logic programming, support vector machines, clustering, Bayesian networks, reinforcement learning, representation learning, similarity and metric learning, sparse dictionary learning, and genetic algorithms.

Accordingly, the learning engine 32 (as executed by the electronic processor 26) performs machine learning using the received training data to develop a model that maps sound data to one or more diagnoses. For example, the learning engine 32 may identify a unique signature in received sound data and develop a model that maps the unique signature to a particular diagnosis based on the diagnostic data associated with the received sound data. Accordingly, as described in more detail below, when subsequent sound data is received that includes the same unique signature, the model may provide a diagnosis for a vehicle based on the sound data. Thus, the learning engine 32 generates a model that outputs diagnostic data for a vehicle based on input sound data.

Models generated by the learning engine 32 may be stored in the model database 34. It should be understood that, in some embodiments, the model database 34 is included in a separate device. Furthermore, in some embodiments, models generated by the learning engine 32 may be copied to one or more separate devices, such as other servers or databases external to the learning server 14.

In some embodiments, the learning engine 32 generates different models for different vehicles (e.g., different makes, models, and manufacturing years of vehicles). Accordingly, the learning engine 32 may use received vehicle data to group data associated with similar vehicles together and generate a model. This grouping may cause the generated model to more accurately provide diagnostic data for a particular type of vehicle. For example, a brake malfunction in a large sport utility vehicle may sound different than a brake malfunction in a sports car. Similarly, a worn timing belt in a two year old vehicle may sound different than a worn timing belt in a five year old vehicle. Therefore, separate models may be generated to take into account anomalies between different types of vehicles. It should be understood, however, that in some embodiments, the learning engine 32 may develop a model that takes into account these anomalies without the need for separate models.

Figure 5:
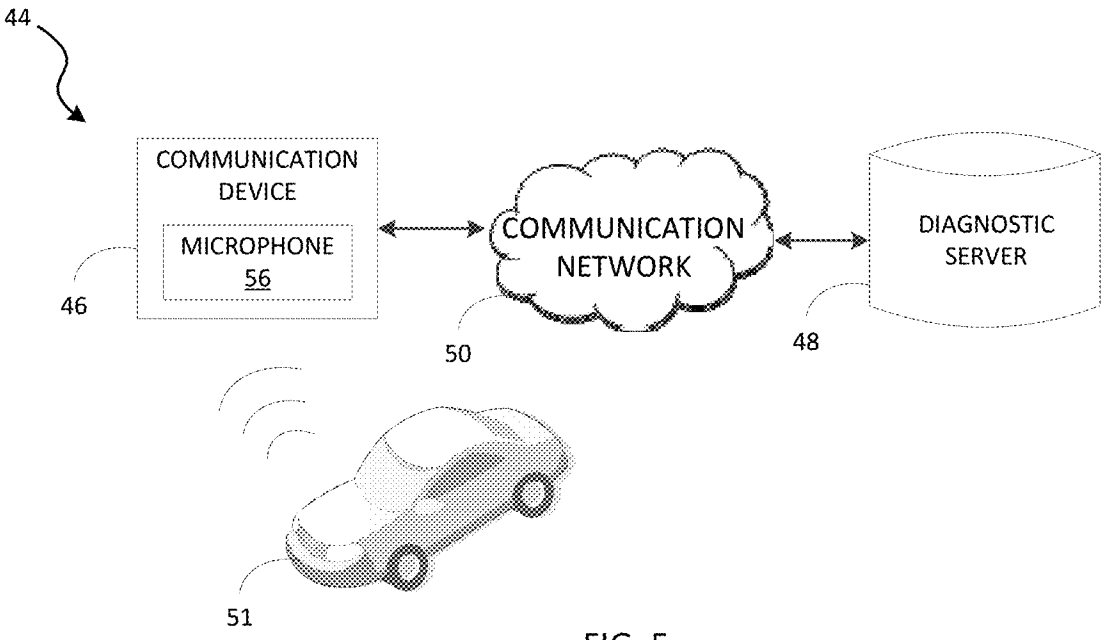
FIG. 5 is a schematic diagram illustrating a system for diagnosing a vehicle that includes a communication device and a diagnostic server.

The stored model may be used to provide a diagnosis for a vehicle. For example, FIG. 5 illustrates a system 44 for diagnosing a vehicle using the model generated by the learning engine 32 according to one embodiment. As illustrated in FIG. 5, the system 44 includes a communication device 46 and a diagnostic server 48. In some embodiments, the communication device 46 communicates with (e.g., transmits data to and receives data from) the diagnostic server 48 over a communication network 50. The communication network 50 may include the Internet, a cellular network, a public network, a private network, or other wired or wireless network. It should be understood that in some embodiments, the communication network 50 includes a direct channel of communication between the communication device 46 and the diagnostic server 48 (e.g., a dedicated wired connection). Furthermore, in some embodiments, the communication device 46 communicates with the diagnostic server 48 indirectly through one or more intermediary computing devices. For example, the communication device 46 may communicate (e.g., through a wired or wireless connection or network) with an intermediary computing device (e.g., a desktop computer, a laptop computer, a tablet computer, a communication device, such as a smart telephone or smart wearable, and the like), and the intermediary computing device may communicate with the diagnostic server 48 (e.g., through the communication network 50). Also, in some embodiments, the communication device 46 and the diagnostic server 48 are combined into a single device.

The communication device 46 may be a desktop computer, a laptop computer, a tablet computer, a smart telephone, a smart wearable (e.g., a smart watch), a smart television, a kiosk, and the like. Also, in some embodiments, the communication device 46 includes the diagnostic tool 12 described above. As described below, the communication device 46 receives sound data associated with a second vehicle 51 through a microphone and transmits the sound data to the diagnostic server 48 as part of a diagnosis request for the second vehicle 51. In some embodiments, the second vehicle 51 is a different vehicle than the first vehicle 11.

Figure 6:
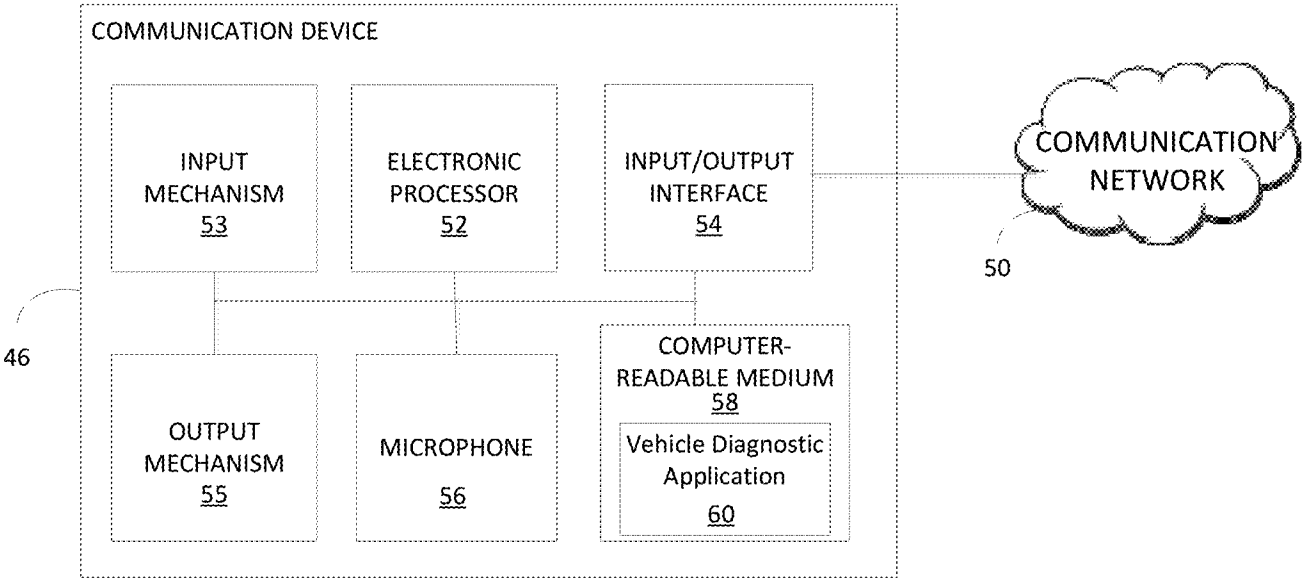
FIG. 6 is a block diagram illustrating the communication device of FIG. 5.

FIG. 6 schematically illustrates the communication device 46 according to one embodiment. As illustrated in FIG. 6, the communication device 46 includes an electronic processor 52 (e.g., a microprocessor or other programmable device), one or more input mechanisms 53, one or more output mechanisms 55, an input/output interface 54, a non-transitory computer-readable medium 58, and a microphone 56 communicating over one or more wired or wireless connections or buses. It should be understood that the communication device 46 may include fewer or additional components than as illustrated in FIG. 6 and may include components in configurations other than the configuration illustrated in FIG. 6. Also, the communication device 46 may be configured to perform additional functionality than the functionality described herein.

The electronic processor 52 is configured to retrieve instructions and data from the computer-readable medium 58 (e.g., read-only memory, random-access memory, or combinations thereof) and execute, among other things, the instructions. For example, as illustrated in FIG. 6, in some embodiments, the computer-readable medium 58 stores a vehicle diagnostic application 60 executable by the electronic processor 52 to perform a set of functions including the methods described herein. In some embodiments, as described below, the vehicle diagnostic application 60, when executed by the electronic processor 52, generates a plurality of user interfaces displayed on the communication device 46 that allow a user of the communication device 46 to record and submit sound data to the diagnostic server 48 and receive a response from the diagnostic server 48.

The input mechanisms 53 may include a keyboard, a mouse, a keypad, a button, a touchscreen, a trackball, a joystick, a camera, and the like for receiving input from a user of the communication device 46. Similarly, the output mechanisms 55 may include a display device, a speaker, a printer, and the like for providing output to a user of the communication device 46.

The input/output interface 54 transmits data from the communication device 46 to external systems, networks, and/or devices and receives data from external systems, networks, and/or devices. The input/output interface 54 may also store data received from external sources to the computer-readable medium 58 and/or provide received data to the electronic processor 52. As illustrated in FIG. 6, in some embodiments, the input/output interface 54 communicates with the communication network 50 (e.g., for communicating with the diagnostic server 48). Alternatively or in addition, the input/output interface 54 may include a connector or port for receiving a wired connection to the diagnostic server 48 or an intermediate computing device as described above.

Figure 7:
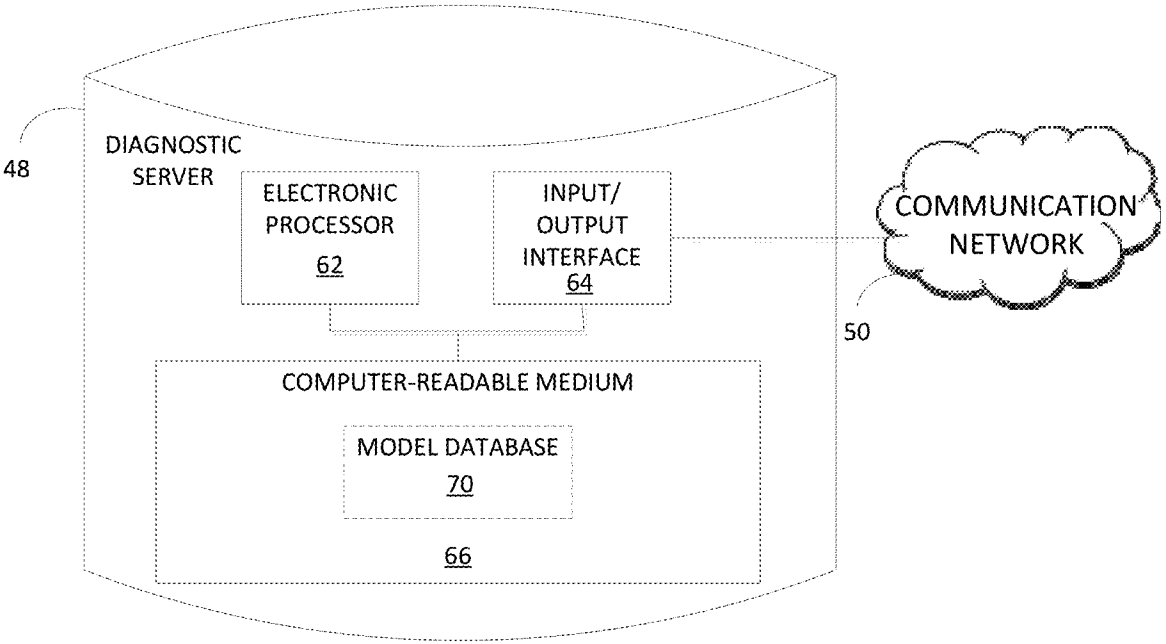
FIG. 7 is a block diagram illustrating the diagnostic server of FIG. 5.

FIG. 7 schematically illustrates the diagnostic server 48 according to one embodiment of the invention. As illustrated in FIG. 7, the diagnostic server 48 includes an electronic processor 62 (e.g., a microprocessor or other programmable device), an input/output interface 64, and a non-transitory computer-readable medium 66. It should be understood that the diagnostic server 48 may include fewer or additional components than as illustrated in FIG. 7 and may include components in configurations different than the configuration illustrated in FIG. 7. Also, the diagnostic server 48 may be configured to perform additional functionality than the functionality described below. In addition, the functionality performed by the diagnostic server 48 as described below may be distributed among multiple servers or devices. For example, in some embodiments, the learning server 14 and the diagnostic server 48 are combined in a single server.

The electronic processor 62 is configured to retrieve instructions and data from the computer-readable medium 66 (e.g., read-only memory, random-access memory, or combinations thereof) and execute, among other things, the instructions. In particular, as illustrated in FIG. 7, the computer-readable medium 66 may store a model database 70. As described above with respect to the model database 34 included in the learning server 14, the model database 70 may store a plurality of models generated by the learning engine 32 for diagnosing a vehicle. The electronic processor 62 is configured to execute instructions stored in the computer-readable medium 66 to perform a set of functions including the methods described herein.

The input/output interface 64 transmits data from the diagnostic server 48 to external systems, networks, and/or devices and receives data from external systems, networks, and/or devices. The input/output interface 64 may also store data received from external sources to the computer-readable medium 66 and/or provide received data to the electronic processor 62. As illustrated in FIG. 7, in some embodiments, the input/output interface 64 communicates with the communication network 50 (e.g., for communicating with the communication device 46, an intermediary computing device, or both).

Figure 8:
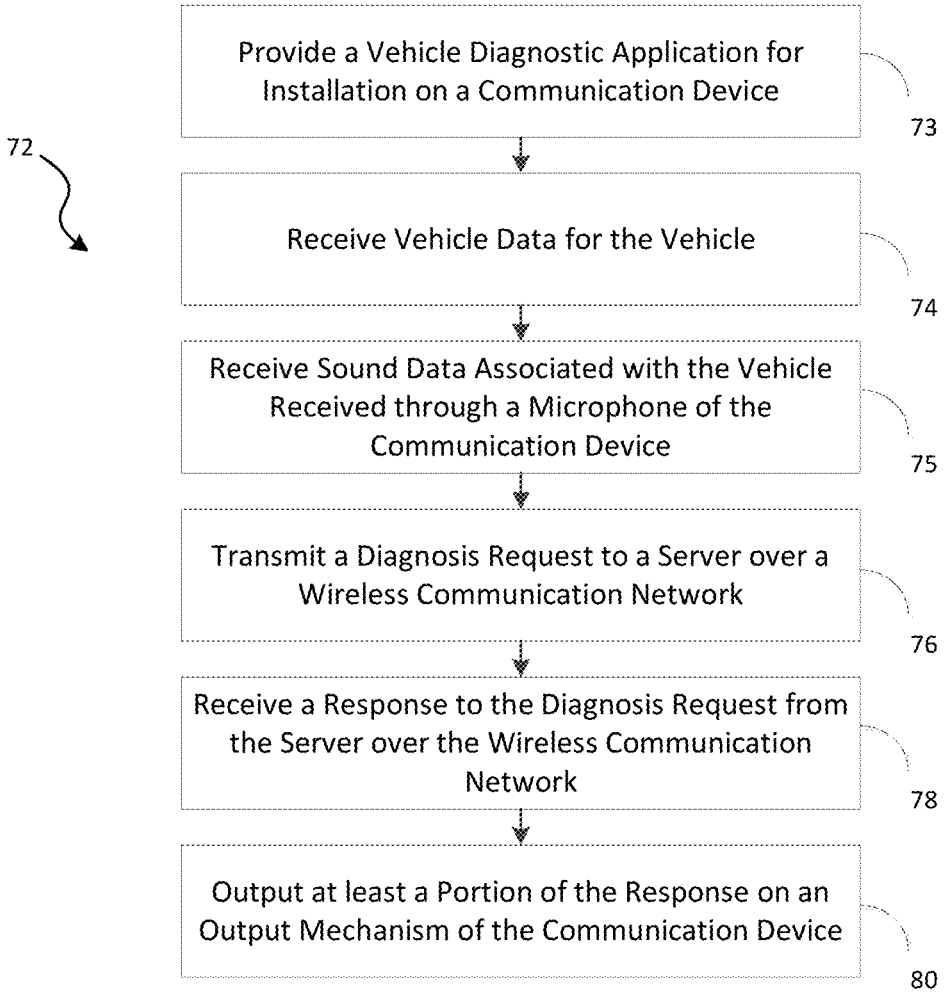
FIG. 8 is a flowchart illustrating a method of diagnosing a vehicle using the system of FIG. 5.

FIG. 8 illustrates a method 72 of diagnosing the second vehicle 51 performed by the system 44 according to one embodiment. It should be understood that, in some embodiments, the method 72 or portions thereof may be used with the method 36 or portions thereof as described above (e.g., to develop and use a model for diagnosing a vehicle).

As illustrated in FIG. 8, the method 72 includes providing the vehicle diagnostic application 60 to the user for installation on the communication device 46 (at block 73). In some embodiments, the communication device 46 downloads the vehicle diagnostic application 60 from a website or a software application executed by the communication device 46 to access a collection of downloadable software applications (e.g., a software application store). In some embodiments, the communication device 46 downloads the vehicle diagnostic application 60 through the communication network 50.

After the vehicle diagnostic application 60 is downloaded and installed on the communication device 46, the electronic processor 52 executes the vehicle diagnostic application 60 to receive vehicle data for the second vehicle 51 (at block 74). For example, as noted above, the vehicle diagnostic application 60 may generate one or more user interfaces (e.g., graphical user interfaces) that include one or more input mechanisms and selection mechanisms for providing input. As noted above, the vehicle data may include a vehicle identification number (VIN) for the second vehicle 51, a manufacturing year of the second vehicle 51, a make of the second vehicle 51, a model of the second vehicle 51, a repair history for the second vehicle 51, and the like. In some embodiments, the vehicle data may also include a description of one or more problems reported by a user of the second vehicle 51. In some embodiments, the communication device 46 receives the vehicle data through an input mechanism 53 of the communication device 46. For example, in some embodiments, the vehicle diagnostic application 60 may display a user interface that allows a user to input vehicle data via a pull-down menu or by entering the vehicle data into a text field (e.g., using a keypad, a keyboard, or a touchscreen). In other embodiments, the vehicle diagnostic application 60 may obtain the vehicle data, such as by reading a VIN in a vehicle (e.g., a barcode) or accessing one or more internal or external databases or data storage locations for the vehicle data. Also, in some embodiments, the communication device 46 (via the vehicle diagnostic application 60) may automatically identify and input the vehicle information based on an image of the second vehicle 51 (e.g., captured using a camera of the communication device 46).

In some embodiments, vehicle data may be stored on the communication device 46 (e.g., within the computer-readable medium 58), which allows the vehicle to be reused by the vehicle diagnostic application 60 at a later time. For example, the vehicle diagnostic application 60 may allow a user of the communication device 46 to create one or more vehicle profiles associated with vehicle data. Accordingly, the vehicle diagnostic application 60 may receive the vehicle data based on a selection of an existing vehicle profile by the user of the communication device 46. In some embodiments, the vehicle data, vehicle profiles, or both may be shared.

As illustrated in FIG. 9, the electronic processor 52 also executes the vehicle diagnostic application 60 to receive sound data for the second vehicle 51 (at block 75). The sound data is recorded through the microphone 56 of the communication device 46. For example, the user may use the microphone 56 to record one or more sound files (e.g., a .WAV file or an .MP3 file). In some embodiments, the vehicle diagnostic application 60 pre-processes the sound data to improve the quality of the recorded sound data. In such a configuration, the vehicle diagnostic application 60 may instruct the user (e.g., audibly or visually through a user interface) to re-record sound data (e.g., when recorded sound data is not adequate).

In some embodiments, the vehicle diagnostic application 60 also provides instructions to the user of the communication device 46 for recording the sound data. For example, the vehicle diagnostic application 60 may provide instructions in an audible form, a visual form, or a combination thereof. The instructions may instruct the user where to position the communication device 46 (e.g., the microphone 56) with respect to the second vehicle 51 (e.g., within the second vehicle 51, positioned in front of the second vehicle 51 with the hood open, positioned to the rear of the second vehicle 51, and the like), an instruction of a duration for recording the sound data (e.g., at least thirty seconds), an instruction for operating the vehicle while recording the sound data (e.g., accelerating the vehicle, braking the vehicle, and the like), or a combination thereof. In some embodiments, the sound data may include sound recorded under different circumstances for the second vehicle 51 (e.g., with acceleration, with no acceleration, with braking, from the front of the second vehicle 51, and the like).

Returning to FIG. 8, the communication device 46 generates and transmits a diagnosis request to the diagnostic server 48 over the communication network 50 (at block 76). The diagnosis request includes the sound data and the vehicle data. The diagnostic server 48 receives the diagnosis request and accesses models stored in the model database 70 to perform a diagnosis for the second vehicle 51. For example, in some embodiments, the diagnostic server 48 uses the vehicle data included in the request to select a model from a plurality of models stored in the model database 70. As noted above, the learning engine 32 may develop a plurality of models, wherein each model is associated with similar vehicles (e.g., vehicles of the same make, model, year, and combinations thereof). Accordingly, the diagnostic server 48 may use vehicle data included in the request to select a model that is associated with vehicles most similar to the received vehicle data (e.g., same make, model, and year). In some embodiments, the diagnostic server 48 may also access additional data not included in the request to select an appropriate model. For example, the diagnostic server 48 may determine participant components of the second vehicle 51 (e.g., engine size, engine model, brake system, and the like) based on the vehicle data by accessing data locally stored on the diagnostic server 48 or stored in an external data storage location. It should also be understood that, in some embodiments, the diagnostic server 48 may select more than one model. In these situations, the diagnostic server 48 may use the output from each selected model to generate a set of diagnoses or may process the output from each selected model to identify a single diagnosis (e.g., the most commonly output diagnosis).

After selecting the appropriate model, the diagnostic server 48 applies the selected model to the sound data included in the diagnosis request. As noted above, each model may take sound data (and, optionally, additional data) and output one or more diagnoses for a vehicle. Accordingly, the diagnostic server 48 applies a selected model to the sound data to generate a response to the diagnosis request. The response may include a diagnosis for the second vehicle 51, suggested service for the second vehicle 51 (e.g., an oil change, new tires, new brakes, a new timing belt, and the like), a ranking of diagnoses for the second vehicle 51, an identification of a malfunctioning part of the second vehicle 51, or a combination thereof. In some embodiments, a diagnosis included in the response may be associated with a confidence level that indicates how likely an identified fault included in the diagnosis has actually occurred. It should be understood that the details of the diagnostic report (e.g., the response) is not limited to the information listed above and may include additional vehicle information. Also, it should be understood that, in some embodiments, the diagnostic server 48 may respond to a diagnosis request with a request for additional data before providing a response to the diagnosis. For example, the diagnostic server 48 may request additional vehicle data or additional sound data before generating a response. The diagnostic server 48 may request this additional data to narrow down a list of potential diagnoses output by the models.

After the diagnostic server 48 generates the response, the diagnostic server 48 transmits the response to the communication device 46 (e.g., over the communication network 50), which is received by the communication device 46 (at block 78). The communication device 46 (through the vehicle diagnostic application 60) outputs at least a portion of the response to a user of the communication device 46 (at block 80). For example, in some embodiments, the communication device 46 outputs at least a portion of the response through an output mechanism 55 of the communication device 46, such as a display.

It should be understood that in some embodiments, the diagnostic server 48 hosts the vehicle diagnostic application 60. Accordingly, in these embodiments, the electronic processor 52 of the communication device 46 may execute a browser application stored in the computer-readable medium 58 to access the hosted vehicle diagnostic application 60. Alternatively or in addition, the electronic processor 52 may execute a proprietary software application to access the functionality provided by the vehicle diagnostic application 60 hosted by the diagnostic server 48. Similarly, it should be understood that some of the functionality performed by the diagnostic server 48 may be performed by the communication device 46. For example, in some embodiments, the communication device 46 may receive a model from the diagnostic server 48 and apply the received model to the sound data. In this situation, the communication device 46 may only provide vehicle data to the diagnostic server 48.

Also, it should be understood that as an alternative or in addition to using submitted sound data to generate models, collected sound data may be used to establish a library of vehicle sounds. A user (e.g., through the communication device 46) could access the library of vehicle sounds, upload sound data, and conduct a search of the library for sound data matching the uploaded sound data (e.g., sound data including a unique or similar sound signature). Once a match is found, data associated with the sound data in the library (e.g., a diagnosis, a repair, comments from the submitter) may help the user uploading the sound data perform a diagnosis of their vehicle. Similarly, in some embodiments, a user may be able to search and browse the library of the vehicle sounds to manually identify sound data that matches a sound made by the user's vehicle (e.g., without having to upload sound data).

Furthermore, it should be understood that the sound data used by the learning engine 32 to develop the models may also obtain training data from sources other than the diagnostic tool 12. For example, sound data and associated diagnostic data may be submitted by users of the communication device 46. In particular, after receiving a response through the vehicle diagnostic application 60, a user of the communication device 46 may specify whether a diagnosis included in the response was correct. This feedback may be provided to the learning engine 32 to update or tune a previously generated model or develop a new model. Similarly, it should be understood that the models generated by the learning engine 32 may periodically be updated or tuned or replaced with new models based on new training data.

Also, in some embodiments, one or more microphones may be installed in a vehicle, which may be used to collect sound data for training data, for a diagnosis request, or both. Sound data collected by in-vehicle microphones may be transmitted to one or more servers (e.g., the learning server 14, the diagnostic server 48, or both), such as through a transceiver included in the vehicle. Alternatively or in addition, sound data collected by in-vehicle microphones may be provided to an intermediary computing device (e.g., the diagnostic tool 12, the communication device 46, or another computing device) over a wired or wireless connection.

Furthermore, in some embodiments, sound data and associated diagnostic data (e.g., error codes) may be provided by an original equipment manufacturer (OEM) for normal operation of a vehicle and malfunctioning operation of a vehicle. This data may be provided to the learning server 14 through the communication network 16. Alternatively or in addition, this data may be loaded and stored on the learning server 14.

Thus, embodiments described herein provide systems and methods for diagnosing a vehicle using sound data. However, the systems and methods described herein may be used to diagnosis other types of machines. For example, in some embodiments, the systems and methods described herein may be used with other mechanical applications or systems, such as elevator systems or manufacturing systems.

Various features and advantages of the invention are set forth in the following claims.

What is claimed is:

1. A system for diagnosing a vehicle, the system comprising:

a diagnostic tool including a microphone for recording first sound data associated with a first vehicle; and a server having a memory for storing instructions and an electronic processor for executing the instructions stored in the memory to receive training data, the training data including the first sound data and diagnostic data associated with the first vehicle, develop a first model based on the training data, receive a diagnosis request including second sound data and vehicle data associated with a second vehicle, select a model from a plurality of models based on the vehicle data, and determine a diagnosis for the second vehicle based on the second sound data and the selected model.

2. The system of claim 1, wherein the training data further includes vehicle data for the first vehicle.

3. The system of claim 2, wherein the training data for the first vehicle includes at least one selected from the group consisting of mileage of the first vehicle and a repair history of the first vehicle.

4. The system of claim 1, wherein the diagnostic data includes at least one selected from the group consisting of an error code for the first vehicle and a repair history of the first vehicle.

5. The system of claim 1, wherein the diagnostic tool includes an interface for reading the diagnostic data from a communication bus of the first vehicle.

6. The system of claim 1, wherein the electronic processor executes the instructions stored in the memory to develop the first model using a machine learning function.

7. The system of claim 1, wherein the diagnostic tool includes an interface for wirelessly communicating the first sound data to the server.

8. The system of claim 1, wherein the diagnostic tool includes an interface for communicating the first sound data to a computing device, wherein the computing device communicates the first sound data to the server over a communication network.

9. A system for diagnosing a vehicle, the system comprising:

a server storing a plurality of models based on training data that includes sound data and diagnostic data from other vehicles; and a communication device including a microphone, wherein the communication device is configured to receive sound data received through the microphone associated with the vehicle, and wirelessly transmit a diagnosis request to the server over a communication network, the diagnosis request including the sound data and vehicle data, wherein the server is configured to receive the diagnosis request, select a model from the plurality of models based on the vehicle data, apply the model to the sound data to generate a response to the diagnosis request, and wirelessly transmit the response to the diagnosis request to the communication device over the communication network, wherein the communication device is configured to output at least a portion of the response on an output mechanism of the communication device, the response including at least one diagnosis of the vehicle.

10. The system of claim 9, wherein the communication device is further configured to output an instruction for recording the sound data.

11. The system of claim 10, wherein the instruction includes at least one selected from the group consisting of an instruction of where to position the communication device with respect to the vehicle, an instruction of a duration for recording the sound data, and an instruction for operating the vehicle while recording the sound data.

12. The system of claim 9, wherein the vehicle data includes at least one selected from the group consisting of mileage of the vehicle and a repair history of the vehicle.

13. The system of claim 9, wherein the response includes at least one selected from the group consisting of a ranking of diagnoses for the vehicle and an identification of malfunctioning part of the vehicle.

14. A method of diagnosing a vehicle, the method comprising:

providing a vehicle diagnostic application for installation on a communication device including an electronic processor;

receiving, via the vehicle diagnostic application executed by the electronic processor of the communication device, vehicle data;

receiving, via the vehicle diagnostic application executed by the electronic processor of the communication device, sound data associated with the vehicle received through a microphone of the communication device;

transmitting, via the vehicle diagnostic application executed by the electronic processor of the communication device, a diagnosis request to a server over a wireless communication network, the diagnosis request including the sound data and the vehicle data;

at the server, selecting a model from a plurality of models based on the received vehicle data, wherein the plurality of models are based on training data that includes sound data and diagnostic data from other vehicles;

applying the model to the received sound data to generate a response to the diagnosis request;

receiving, via the vehicle diagnostic application executed by the electronic processor of the communication device, the response to the diagnosis request from the server over the wireless communication network; and outputting, via the vehicle diagnostic application executed by the electronic processor of the communication device, at least a portion of the response on an output mechanism of the communication device, wherein the response includes a diagnosis of the vehicle.

15. The method of claim 14, further comprising providing, via the vehicle diagnostic application executed by the electronic processor of the communication device, an instruction, the instruction including at least one selected from the group consisting of an instruction of a duration for recording the sound data and an instruction for operating the vehicle while recording the sound data.

16. The method of claim 14, wherein transmitting the diagnosis request including the vehicle data includes transmitting the diagnosis request including at least one selected from the group consisting of mileage of the vehicle and a repair history of the vehicle.

17. The method of claim 14, wherein outputting at least the portion of the response includes outputting at least one selected from the group consisting of a ranking of diagnoses for the vehicle and an identification of malfunctioning part of the vehicle.

18. The method of claim 9, wherein the models include different models for different vehicles and the server is configured to use machine learning to develop the model based on the sound data and diagnostic data from the vehicle.

19. The method of claim 18, wherein the models are different for different ages of vehicles.

20. The method of claim 1, wherein the models include different models for different ages of vehicles, and wherein the models are developed by the electronic processor using a machine learning function.

* * * * *